US010723163B2

(12) United States Patent
Homeier

(10) Patent No.: US 10,723,163 B2
(45) Date of Patent: Jul. 28, 2020

(54) METHOD FOR COATING AND IDENTIFYING WORKPIECES

(71) Applicant: HOMAG GmbH, Schopfloch (DE)

(72) Inventor: Achim Homeier, Schopfloch (DE)

(73) Assignee: HOMAG GmbH, Schopfloch (DE)

( * ) Notice: Subject to any disclaimer, the term of this patent is extended or adjusted under 35 U.S.C. 154(b) by 0 days.

(21) Appl. No.: 15/741,178

(22) PCT Filed: Jul. 1, 2016

(86) PCT No.: PCT/EP2016/065520
§ 371 (c)(1),
(2) Date: Dec. 29, 2017

(87) PCT Pub. No.: WO2017/001667
PCT Pub. Date: Jan. 5, 2017

(65) Prior Publication Data

US 2018/0194155 A1 Jul. 12, 2018

(30) Foreign Application Priority Data

Jul. 2, 2015 (DE) ..... 10 2015 212 409

(51) Int. Cl.

| | |
|---|---|
| ***B42D 25/324*** | (2014.01) |
| ***B42D 25/369*** | (2014.01) |
| ***B42D 25/378*** | (2014.01) |
| ***B41M 5/00*** | (2006.01) |
| ***B41M 3/14*** | (2006.01) |

(Continued)

(52) U.S. Cl.
CPC ..... *B42D 25/324* (2014.10); *B41M 3/144* (2013.01); *B42D 25/369* (2014.10); *B42D 25/378* (2014.10); *B44C 5/0446* (2013.01); *G09F 3/00* (2013.01); *G09F 3/0298* (2013.01); *B41M 5/0047* (2013.01); *B41M 5/0076* (2013.01); *B41M 5/0088* (2013.01)

(58) Field of Classification Search
CPC .. B42D 25/324; B42D 25/369; B42D 25/378; B27D 5/003; B27D 5/006; B29C 63/003
USPC ..... 347/95, 98, 100, 102
See application file for complete search history.

(56) References Cited

U.S. PATENT DOCUMENTS 4,392,204 A * 7/1983 Prim ..... B27B 31/06 101/18
8,038,236 B2 * 10/2011 Gauss ..... B05B 12/122 347/4

(Continued)

FOREIGN PATENT DOCUMENTS

AT 508824 A2 4/2011
DE 3901806 A1 7/1990

(Continued)

OTHER PUBLICATIONS

International Preliminary Report on Patentability from PCT/EP2016/065520, dated Jan. 2, 2018, 12 pages.

*Primary Examiner* — An H Do
(74) *Attorney, Agent, or Firm* — Morgan, Lewis & Bockius LLP

(57) ABSTRACT

The present invention relates to a method for coating and identifying workpieces which preferably consist at least to some extent of wood, wood materials or the like. For this purpose, a curable liquid is used, preferably comprising ink, which, when cured, contains readable information or can receive said readable information.

18 Claims, 1 Drawing Sheet

(51) Int. Cl.
*B44C 5/04* (2006.01)
*G09F 3/00* (2006.01)

(56) References Cited

U.S. PATENT DOCUMENTS

| | | | |
|---|---|---|---|
| 2004/0137203 | A1 | 7/2004 | Adams et al. |
| 2008/0252066 | A1 | 10/2008 | Rapoport et al. |
| 2010/0086701 | A1 | 4/2010 | Iftime et al. |
| 2012/0235076 | A1 | 9/2012 | Iftime et al. |
| 2012/0236065 | A1 | 9/2012 | Iftime et al. |
| 2015/0097907 | A1 | 4/2015 | Kalwa et al. |

FOREIGN PATENT DOCUMENTS

| | | | |
|---|---|---|---|
| DE | 10-2007-004332 | A1 | 7/2008 |
| DE | 10-2007-058029 | A1 | 6/2009 |
| EP | 1726443 | A1 | 11/2006 |
| EP | 2295507 | A1 | 3/2011 |
| JP | 2001-301141 | A | 10/2001 |
| WO | WO-00/11595 | A1 | 3/2000 |

* cited by examiner

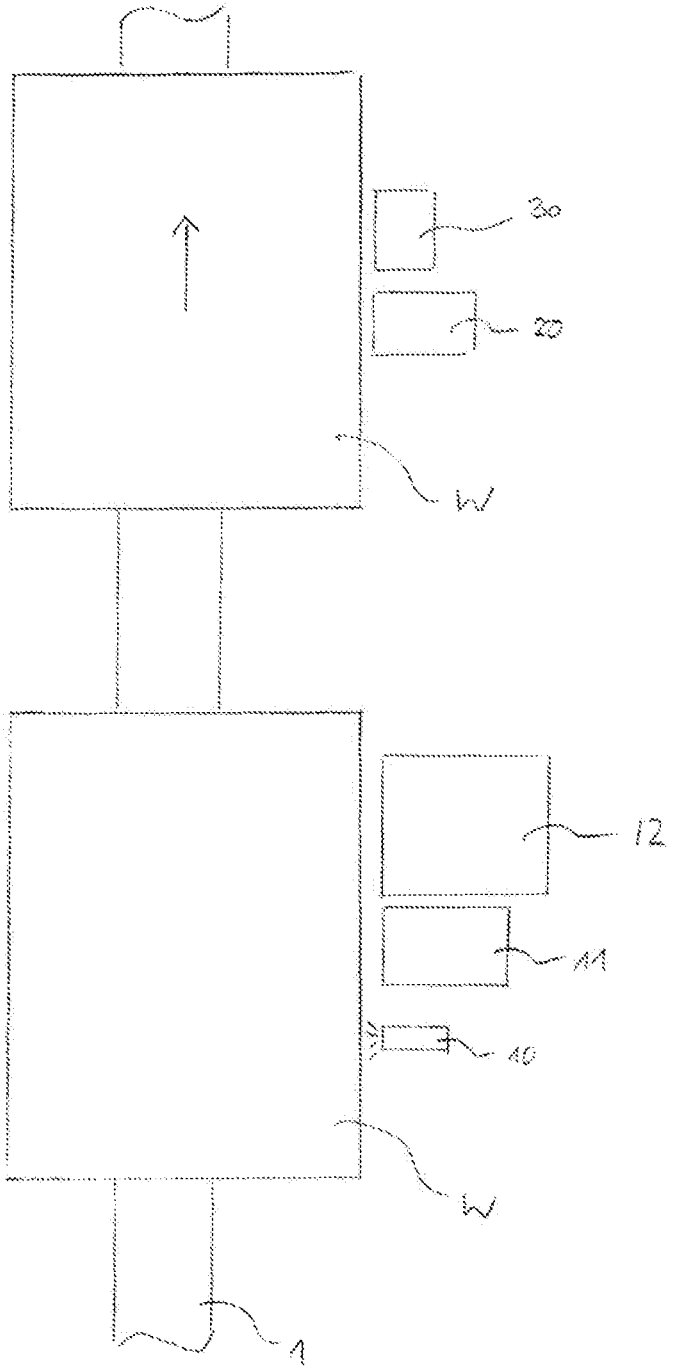
30
20
W
12
11
10
W
1

METHOD FOR COATING AND IDENTIFYING WORKPIECES

TECHNICAL FIELD

The present invention relates to a method for coating and identifying workpieces which preferably at least partially consist of wood, wood materials or the like.

PRIOR ART

Methods for identifying workpieces are already known in the prior art. For example, workpieces are printed with a barcode or a corresponding barcode label is applied to a workpiece. Furthermore, so-called RFID chips are known.

However, the known measures have the disadvantage that they are visible and for identification of a certain workpiece or certain parts of workpieces thereon must remain optically visible in order to guarantee an identification.

If a workpiece, that is, for example, part of a furniture piece, is sold to a consumer, the consumer will not consider a permanent labelling of the workpiece to be acceptable or will remove an identification that is detachably applied to the workpiece. The latter leads to the information regarding a certain workpiece that is being held by means of the identification being lost. This has been proven to be disadvantageous, for example, if the affected workpiece is to be ordered again.

Furthermore, conventional identifying methods can lead to problems of quality with certain surfaces.

SUBJECT MATTER OF THE INVENTION

The present invention aims to provide a method for coating and identifying workpieces with which the aforementioned problems are solved.

As a solution, claim 1 provides a method having the features of the independent claim 1. Further preferred embodiments are stated in the dependent claims.

The method according to the invention comprises the steps provided below: Effecting a relative movement between a workpiece and a print head, in particular an inkjet print head or a laser print head, printing at least one section of the workpiece with a curable liquid, preferably with an ink which, in the cured state, can contain or record readable information, with the curable liquid containing color particles which form a visible surface after the liquid has cured, and/or a further coating that is applied to the at least substantially cured liquid.

The method according to the invention has the advantage that the information which can be made available on the curable liquid on the workpiece remains firmly linked to the workpiece, and the identifying area is not optically visible. Consequently, a permanent identification is guaranteed, for example, for re-manufacturing defective workpieces.

In the cured state, the curable liquid can provide a structured surface or a three-dimensional structure. The further coating can be used to raise the resistance to abrasion or generally to protect the cured liquid.

It is preferred that the readable information is reversible or irreversible. Consequently, information can either be modified or permanently linked with the identified workpiece.

According to one embodiment, the cured liquid contains particles which can be oriented, with the particles being at least partially magnetized or magentizable, preferably ferromagnetic.

Furthermore, the cured liquid can comprise a fluorescent material. Said fluorescent material can consequently only be read under certain environmental conditions. The fluorescent liquid is not optically visible in the common area of use of a workpiece which in particular is a workpiece the furniture industry sector. For example, the curable liquid which comprises a fluorescent material can be coated with a protective layer, for example, a varnish. Furthermore, the readable information provided by means of the fluorescent material can be read by an optical reader.

According to one preferred embodiment, the readable information is a barcode. If the barcode is, for example, formed from a fluorescent material, said barcode is not visible in the common area of use of a workpiece. In case the cured liquid, for example, has orientable particles, with the particles being at least partially magnetized or magentizable, preferably ferromagnetic, areas having the particles can optionally be provided differently spaced from one another or distributed and/or dimensioned in a certain pattern.

After the curable liquid has cured, a form-stable coating material, in particular a strip-shaped edge band, is preferably applied thereto as a further coating. Consequently, the curable liquid is covered and is no longer visible to the consumer.

According to one embodiment, a paste-like compound for forming a three-dimensional structure is applied to the area of the cured liquid. Aside from providing a three-dimensional structure on the workpiece, the paste-like compound can also cover the cured liquid. This paste-like compound can be applied by means of a print head.

Alternatively or additionally, it is conceivable to apply a further curable liquid, in particular an ink, to the curable liquid after it has cured.

According to one embodiment, the readable information is read by electrical and/or magnetic and/or electro-magnetic fields. Consequently, the reading of information can be contactless. Alternatively or additionally, an optical reader is possible, particular in the case of a curable liquid which has a fluorescent material.

According to one further embodiment, the readable information contains data regarding the identified workpiece, in particular the dimension, regarding the workpiece number, regarding the manufacturer and/or the date of manufacture and/or the type of material and/or the material properties. The type and scope of the information can consequently be adapted to the specific requirements.

In particular, said workpiece is a part of a workpiece of a wood material, a solid wood workpiece or a wood workpiece, a workpiece of a composite material such as a particleboard or a layer material. Furthermore, workpieces are conceivable which comprise synthetic material in sections or mineral-bound materials such as so-called Corian® boards. Such workpieces are particularly used in the furniture or building component industry.

Purely by way of example, the said workpiece can be a countertop, in particular a kitchen countertop. Such a kitchen countertop can be provided in sections with a Teflon ink as a further coating in order to make an area in which stovetops are to be later inserted more resistant to heat exposure. Moreover, a reinforced moisture-repellent layer can be provided in certain areas of the workpiece. Alternatively and additionally, "dirt-repellent" components can be mixed in to protect the workpiece.

According to one further embodiment of the present invention, the curable liquid which, in the cured state, can contain or record readable information can be applied to or introduced into a planar side of the workpiece or into a cutout provided in the workpiece, in particular a groove or bore.

According to a further variant, a structure is imprinted into the curable liquid before said curable liquid has fully cured. Consequently, the cured liquid can provide a three-dimensional structure upon which a further surface layer can be applied by means of the further coating.

Preferably the effecting of a relative movement between the workpiece and the print head is performed by means of a conveyor device, in particular a belt conveyor or chain conveyor.

Alternatively, it is possible to guide the print head along a side of the workpiece to be coated. The workpiece can be held by means of a holding device, for example suctions clamps or clamping devices.

BRIEF DESCRIPTION OF THE DRAWINGS

FIG. 1 is a schematic plan view of a device for performing the method for coating and identifying workpieces.

DETAILED DESCRIPTION OF THE PREFERRED EMBODIMENT

One preferred embodiment of the present invention is described below in detail by means of the enclosed FIGURE. Further modifications of certain features in this context can each be combined with one another in order to form new embodiments.

The device shown in a plan view comprises a conveyor means 1 which, in the present case, is a rotating belt. Additionally, a further rotating belt can be provided which presses (so-called top pressure) the workpieces W against the rotating belt 1 depicted in FIG. 1 In this manner, the workpieces W placed on the conveyor belt 1 are conveyed in the through-feed direction (arrow in FIG. 1) and guided past several machining devices.

In particular, the device comprises a print head 10 that is provided laterally to the conveyor belt 1, the print head 10 being configured to print at least a narrow side of the plate-shaped workpiece W. In the present embodiment example, the print head 10 is arranged in a horizontal direction. Additionally, it is possible that the print head 10 is rotatably mounted by means of a pivot axle.

According to one embodiment of the present invention, the ink applied by the print head 10, which in particular is an inkjet print head or a laser print head, contains magnetic or magnetizable particles.

According to one first variant of the present invention, the particles can be applied to the respective workpiece W in the form of a line matrix. Alternatively, it is possible that the ink that is sprayed onto the workpiece by the print head 10 contains magnetic particles or particles having fluorescent properties that are integrated into the actual ink.

Downstream from the print head 10, a curing unit 11 is located in the through-feed direction of the workpieces W for curing in sections the ink applied with the print head 10. For example, the curing unit 11 can be a hot air source with which at least the surface of the applied ink which points away from workpiece W is cured.

A coating unit 12, which is also a print head in the present embodiment, is arranged downstream from the curing unit 11 in the through-feed direction Consequently, the ink applied by the print head 10 is provided with a further coating, in particular an ink or a varnish. The coating unit 12 can be provided with a pivot axle which enables workpieces to be printed "across the edge". By printing "across the edge" corner and seam areas can be covered by means of the ink or the coating.

Alternatively, it is possible, by means of the coating unit 12 to supply a form-stable coating material such as an edge band and to apply it to the workpiece side which had been printed by the print head 10 in the preceding step.

If a flat identification area is applied by the print head 10 which is per se optically visible, said identification area will be covered by a coating supplied by the coating unit 12 or by a coating that is applied to the workpiece.

If the ink applied by the print head 10 is a coating material which already contains such color particles that are used for forming a visible surface, for example, a transparent varnish can therefore be applied by the coating unit 12.

After the workpiece has been identified, said workpiece is guided in through-feed to an encoder 20. According to one embodiment, the encoder 20 comprises a magnetic head. After the ink applied by the print head 10 has at least partially cured, or according to one variant is in a flowable state in sections, the particles can be arranged by the encoder 20 and can consequently be provided for permanent storage of information on the workpiece.

A further curing unit 30 can be arranged in the through-feed direction downstream to the encoder 20. With said further curing unit 30, the orientations of the particles in the ink that are made by the encoder 20 are fixed and furthermore the ink as well as the further coating applied by the coating unit 12 are fully cured so that the workpiece W can subsequently be removed from the device.

Although the present invention was described with reference to FIG. 1 by means of a device in which the workpieces are moved relative to the said machining devices, such as the print head 10, the present invention is not restricted thereto. Alternatively, it is possible to move one or more machining devices, such as the print head 10, relative to a workpiece.

It is especially preferred to compile the print head 10, the curing unit 11 and the coating unit 12 into one aggregate. Alternatively, it is possible to provide the print head 10, the curing unit 11, the coating unit 12, encoder 20 and the further curing unit 30 in an aggregate.

Such an aggregate can be exchanged in an interface of a CNC machine, for example, a hollow-taper-shank interface.

This patent application claims the priority of German patent application 10 2015 212 409.6, the content of the disclosure of which is hereby incorporated by reference

The invention claimed is:

1. A method for coating workpieces, in particular at least a narrow side of a preferably plate-shaped workpiece, having the steps:

effecting a relative movement between a workpiece and a print head, wherein the print head is at least one of an inkjet print head or a laser print head;

printing at least one section of the workpiece with a curable liquid, preferably with an ink which, in a cured state, comprises readable information, wherein the curable liquid furthermore comprises particles having fluorescent properties and color particles which form a visible decoration after the curable liquid has cured; and applying a protective layer onto the cured liquid to render the readable information not optically visible.

2. The method according to claim 1, wherein the readable information is reversible or irreversible.

3. The method according to claim 1, wherein the cured liquid comprises orientable particles, the particles being at least partially magnetized or magentizable, preferably ferromagnetic.

4. The method according to claim 1, wherein the cured liquid has a fluorescent material.

5. The method according to claim 1, wherein the readable information is a barcode.

6. The method according to claim 1, wherein after the curable liquid has cured, a form-stable coating material, in particular a strip-shaped edge band, is preferably applied thereto as a further coating.

7. The method according to claim 1, wherein a further curable liquid is applied to the curable liquid after said curable liquid has cured.

8. The method according to claim 1, wherein the readable information is read by electrical and/or magnetic and/or electro-magnetic fields.

9. The method according to claim 4, wherein the readable information is read by an optical reader.

10. The method according to claim 1, wherein a paste-like compound for forming a three-dimensional structure is applied to the area of the cured liquid.

11. The method according to claim 1, wherein the readable information comprises data regarding the identified workpiece (W), in particular the dimension, regarding the workpiece number, regarding the manufacturer and/or the date of manufacture and/or the type of material and/or the material properties.

12. The method according to claim 1, wherein the workpiece comprises a wood material, in particular a solid wood piece or a wood material, a workpiece of a composite material such as a particleboard or is a layer material, synthetic material and/or comprises mineral materials.

13. The method according to claim 1, wherein the curable liquid is introduced on to a planar side of the workpiece or into a cutout provided in the workpiece, in particular a groove or bore.

14. The method according to claim 1, wherein, prior to the complete curing of the curable liquid, a structure is embossed thereinto.

15. The method according to claim 1, wherein the effecting of a relative movement between the workpiece and the print head is performed by means of a conveyor device, in particular a belt conveyor or chain conveyor.

16. The method according to claim 1, wherein the print head is moved relative to the workpiece.

17. The method according to claim 1, wherein the protective layer comprises a varnish.

18. The method according to claim 1, wherein the protective layer comprises a form-stable coating material comprising a strip-shaped edge band.

* * * * *